US007909988B2

(12) United States Patent
Lapinski et al.

(10) Patent No.: US 7,909,988 B2
(45) Date of Patent: Mar. 22, 2011

(54) PROCESS AND SYSTEM FOR THE TRANSFER OF A METAL CATALYST COMPONENT FROM ONE PARTICLE TO ANOTHER

(75) Inventors: Mark P. Lapinski, Aurora, IL (US); Gregory J. Gajda, Mt. Prospect, IL (US); Jeffry T. Donner, Aurora, IL (US); Richard R. Rosin, Glencoe, IL (US); Marc R. Schreier, Northbrook, IL (US); Simon R. Bare, Wheaton, IL (US)

(73) Assignee: UOP LLC, Des Plaines, IL (US)

( * ) Notice: Subject to any disclaimer, the term of this patent is extended or adjusted under 35 U.S.C. 154(b) by 467 days.

(21) Appl. No.: 12/104,482

(22) Filed: Apr. 17, 2008

(65) Prior Publication Data

US 2009/0261018 A1 Oct. 22, 2009

(51) Int. Cl.
*C10G 35/04* (2006.01)

(52) U.S. Cl. ..... 208/137; 208/134; 208/135; 208/138; 208/139; 208/140

(58) Field of Classification Search ..... 208/134–135, 208/137–140
See application file for complete search history.

(56) References Cited

U.S. PATENT DOCUMENTS 3,892,657 A 7/1975 Wilhelm
3,951,868 A * 4/1976 Wilhelm ..... 502/230
4,487,848 A 12/1984 Robinson et al.
4,522,935 A 6/1985 Robinson et al.
4,529,505 A 7/1985 Robinson et al.
5,211,838 A 5/1993 Staubs et al.
5,221,463 A 6/1993 Kamienski et al.
5,565,090 A 10/1996 Gosling et al.
5,858,908 A 1/1999 Bogdan et al.
5,879,537 A 3/1999 Peters
5,883,032 A 3/1999 Bogdan et al.
5,885,443 A 3/1999 Bogdan et al.
5,958,216 A 9/1999 Glover
6,013,173 A 1/2000 Bogdan
6,034,018 A 3/2000 Sechrist et al.
6,036,845 A 3/2000 Funk et al.
6,106,696 A 8/2000 Fecteau et al.
(Continued)

FOREIGN PATENT DOCUMENTS

AU B-28357/92 5/1993
(Continued)

OTHER PUBLICATIONS

Tyupaev, A.P. et al. (1983). Russian Chemical Bulletin, 31(9), 1843-1847.*
PCT International Search Report and Written Opinion for PCT/US2009/039390 dated Nov. 17, 2009; 7 pages.

*Primary Examiner* — Walter D Griffin
*Assistant Examiner* — Brian McCaig
(74) *Attorney, Agent, or Firm* — Maryann Maas

(57) ABSTRACT

One exemplary embodiment can be a process for facilitating a transfer of a metal catalyst component from at least one donor particle to at least one recipient particle in a catalytic naphtha reforming unit. The process can include transferring an effective amount of the metal catalyst component from the at least one donor particle to the at least one recipient particle under conditions to effect such transfer to improve a conversion of a hydrocarbon feed.

14 Claims, 2 Drawing Sheets

U.S. PATENT DOCUMENTS

| | | | |
|---|---|---|---|
| 6,153,090 | A | 11/2000 | Le Peltier et al. |
| 6,884,340 | B1 | 4/2005 | Bogdan |
| 7,037,871 | B1 | 5/2006 | Galperin et al. |
| 2006/0013763 | A1 | 1/2006 | Baird et al. |
| 2006/0102520 | A1 | 5/2006 | Lapinski et al. |
| 2006/0213811 | A1 | 9/2006 | Clay et al. |
| 2006/0252971 | A1 | 11/2006 | Pilliod et al. |

FOREIGN PATENT DOCUMENTS

| | | | |
|---|---|---|---|
| WO | WO93/12202 | | 6/1993 |
| WO | WO2004/039720 | A2 | 5/2004 |
| WO | WO2005/105957 | A1 | 11/2005 |

* cited by examiner

PROCESS AND SYSTEM FOR THE TRANSFER OF A METAL CATALYST COMPONENT FROM ONE PARTICLE TO ANOTHER

FIELD OF THE INVENTION

The field of this invention generally relates to a process for conversion of hydrocarbons in a reforming unit.

DESCRIPTION OF THE RELATED ART

Numerous hydrocarbon conversion processes can be used to alter the structure or properties of hydrocarbon streams. Generally, such processes include: isomerization from straight chain paraffinic or olefinic hydrocarbons to more highly branched hydrocarbons, dehydrogenation for producing olefinic or aromatic compounds, dehydrocyclization to produce aromatics and motor fuels, alkylation to produce commodity chemicals and motor fuels, transalkylation, and others.

Typically such processes use catalysts to promote hydrocarbon conversion reactions. As the catalysts deactivate, it is generally desirable to regenerate them and/or add new catalyst to improve yields and profitability.

Various catalysts and processes have been developed to convert hydrocarbons. Often, such processes require periodic regeneration to recover lost catalytic activity and/or selectivity due to deactivation. Generally for fixed bed reforming units, the shutting down of the production unit is conducted to regenerate the catalyst whereas for a moving bed or cyclic reforming unit, the catalyst can be regenerated without a unit shutdown. Eventually catalysts can be replaced due to a variety of reasons, one of which being that a new, more profitable catalyst is available. A new catalyst may offer benefits such as increased activity, improved selectivity, reduced deactivation, and/or extended catalyst life. It is well known in the art that catalyst performance can be improved by the addition of a number of promoters to standard reforming catalysts. Generally, one drawback of replacing an existing catalyst with a new catalyst is the cost of replacing a large volume of catalyst, especially if the existing catalyst is not spent. It would be desirable to provide a process that permits the in situ alternation of catalyst by targeting the missing components to minimize the amount of downtime and catalyst utilized while increasing performance.

SUMMARY OF THE INVENTION

One exemplary embodiment can be a process for facilitating a transfer of a metal catalyst component from at least one donor particle to at least one recipient particle in a catalytic naphtha reforming unit. The process can include transferring an effective amount of the metal catalyst component from the at least one donor particle to the at least one recipient particle under conditions to effect such transfer to improve a conversion of a hydrocarbon feed.

Another exemplary embodiment can be a process for facilitating a transfer of indium from at least one donor particle to at least one recipient particle in a reduction zone or a reaction zone of a reforming unit. The process may include reducing the at least one recipient particle in the presence of the added at least one donor particle in a reducing atmosphere. The reducing atmosphere can include a $Cl^-/H_2O$ mole ratio of at least about 0.03:1, and at least one halogen-containing compound facilitating the transfer of a promotionally effective amount of indium from the at least one donor particle to the at least one recipient catalyst.

A further exemplary embodiment can be a system for the in situ transfer of a metal catalyst component in a reforming unit including a first zone having a reducing atmosphere and a second zone having an oxidizing atmosphere. The system may include the reforming unit containing at least one donor particle added to at least one recipient particle. The reforming unit may be operated at conditions to facilitate a transfer of an effective amount of the metal catalyst component from the at least one donor particle to the at least one recipient particle for increasing the effectiveness of the at least one recipient particle to catalyze reforming reactions.

Therefore, a process and system disclosed herein can provide several benefits. Generally, a donor particle is provided that can transfer an effective amount of a metal catalyst component, such as a group IIIA metal, e.g., indium, to a recipient particle. Namely, the metal catalyst component can physically move and disperse from the donor particles to the recipient particles. Such a transfer can change the performance (i.e., the activity, selectivity, and/or deactivation characteristics) of the recipient catalyst that initially did not contain or has insufficient desired amounts of the metal promoter. Such a transfer can also increase the level of a metal promoter of the recipient particle to provide further performance benefits. In a moving bed continuous regeneration unit, a small amount of make-up catalyst is normally added continuously to the unit to keep the inventory constant since some catalyst fines are created and removed from the unit. The donor material can serve as the make-up catalyst, can be added as a portion of the make-up catalyst, or can be added in addition to the make-up catalyst. In the latter embodiment, a portion of the existing catalyst would generally be removed from the unit.

DEFINITIONS

As used herein, the term "zone" can refer to an area including one or more equipment items and/or one or more sub-zones. Equipment items can include one or more reactors or reactor vessels, heaters, separators, exchangers, pipes, pumps, compressors, and controllers. Additionally, an equipment item, such as a reactor or vessel, can further include one or more zones or sub-zones.

As used herein, the term "stream" can be a stream including various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated C1, C2, C3 . . . Cn where "n" represents the number of carbon atoms in the hydrocarbon molecule.

As used herein, the term "metal" generally means an element that forms positive ions when its compounds are in solution.

As used herein, the term "catalytically effective amount" generally means an amount on a catalyst support to facilitate the reaction of at least one compound of a hydrocarbon stream. Typically, a catalytically effective amount is at least about 0.005%, preferably about 0.05%, and optimally about 0.10%, based on the weight of the catalyst.

As used herein, the term "promotionally effective amount" generally means an amount on a catalyst support to increase catalytic performance in a conversion of a hydrocarbon stream to, e.g., facilitate the reaction of at least one compound in the stream. Typically, a promotionally effective amount is at least about 0.005%, preferably about 0.05%, and optimally about 0.10%, based on the weight of the catalyst.

As used herein, the term "effective amount" includes amounts that can improve the catalytic performance and/or facilitate the reaction of at least one compound of a hydrocarbon stream.

As used herein, the term "conditions" generally means process conditions such as temperature, reaction time, pressure, and space velocity, and can include an atmosphere including an oxidizing agent or a reducing agent.

As used herein, the term "oxidizing" generally refers to an environment facilitating a reaction of a substance with an oxidizing agent, such as oxygen.

As used herein, the term "reducing" generally refers to an environment facilitating a substance to gain electrons with a reducing agent, such as hydrogen.

As used herein, the term "support" generally means a porous carrier material that can optionally be combined with a binder before the addition of one or more additional catalytically active components, such as a noble metal, or before subjecting the support to subsequent processes such as oxychlorination or reduction.

As used herein, the term "halogen component" generally means a halide ion or any molecule that contains a halide. A halogen can include chlorine, fluorine, bromine, or iodine. As an example, a halogen component can include a halogen, a hydrogen halide, a halogenated hydrocarbon, and a compound including a halogen and a metal. Typically, a halogen component is comprised in a particle and/or a catalyst.

As used herein, the term "halogen-containing compound" generally means any molecule that contains a halide. A halogen can include chlorine, fluorine, bromine, or iodine. Typically, a halogen-containing compound can be part of a gas stream and include compounds such as chlorine, hydrogen chloride, or perchloroethylene, and may provide a halogen component to a catalyst.

As used herein, the term "catalyst precursor" generally means a support having the addition of one or more catalytically active components, such as a noble metal, but not subjected to subsequent processes, such as reducing or sulfiding, to complete the manufacture of the catalyst. However, in some instances, a catalyst precursor may have catalytic properties and can be used as a "catalyst".

As used herein, the term "particle" generally means a body providing or receiving a metal catalyst component and can be a catalyst particle or a portion thereof such as a support or catalyst precursor. Moreover, the term "catalyst" can refer to catalyst that is active or inactive, i.e. spent.

DETAILED DESCRIPTION

The in situ transfer of a catalytically effective amount of a catalyst metal can occur in units having fixed or moving beds. Preferably, the unit has a moving bed with continuous catalyst regeneration. Generally, at least one donor particle is provided to an existing bed of at least one recipient particle. As an example, in a moving bed continuous regeneration unit, a small amount of make-up catalyst is normally added continuously to the unit to keep the inventory constant because some catalyst fines are created and removed from the unit. The donor particle(s) can serve as the make-up catalyst, can be added as a portion of the make-up catalyst, or can be added in addition to the make-up catalyst. In the latter embodiment, a portion of the existing catalyst can be removed from the unit. Typically, the at least one recipient particle is the existing catalyst in the unit that has been regenerated and reconditioned, as described below. Moreover conditions, such as chloride content in the zones or manufacturing methods of the donor particle, can be controlled to facilitate the transfer of a metal catalyst component, such as a group IIIA element. Thus, such a transfer can change the performance (i.e., the activity, selectivity, and/or deactivation characteristics) of the recipient catalyst that initially does not contain or may contain less than desired amounts of the metal promoter. Additionally, such a transfer can also increase the level of a metal promoter of the recipient particle to provide further performance benefits. Furthermore, the donor catalyst can increase the amount of one or more metal catalyst components of the existing catalyst.

Figure 1:
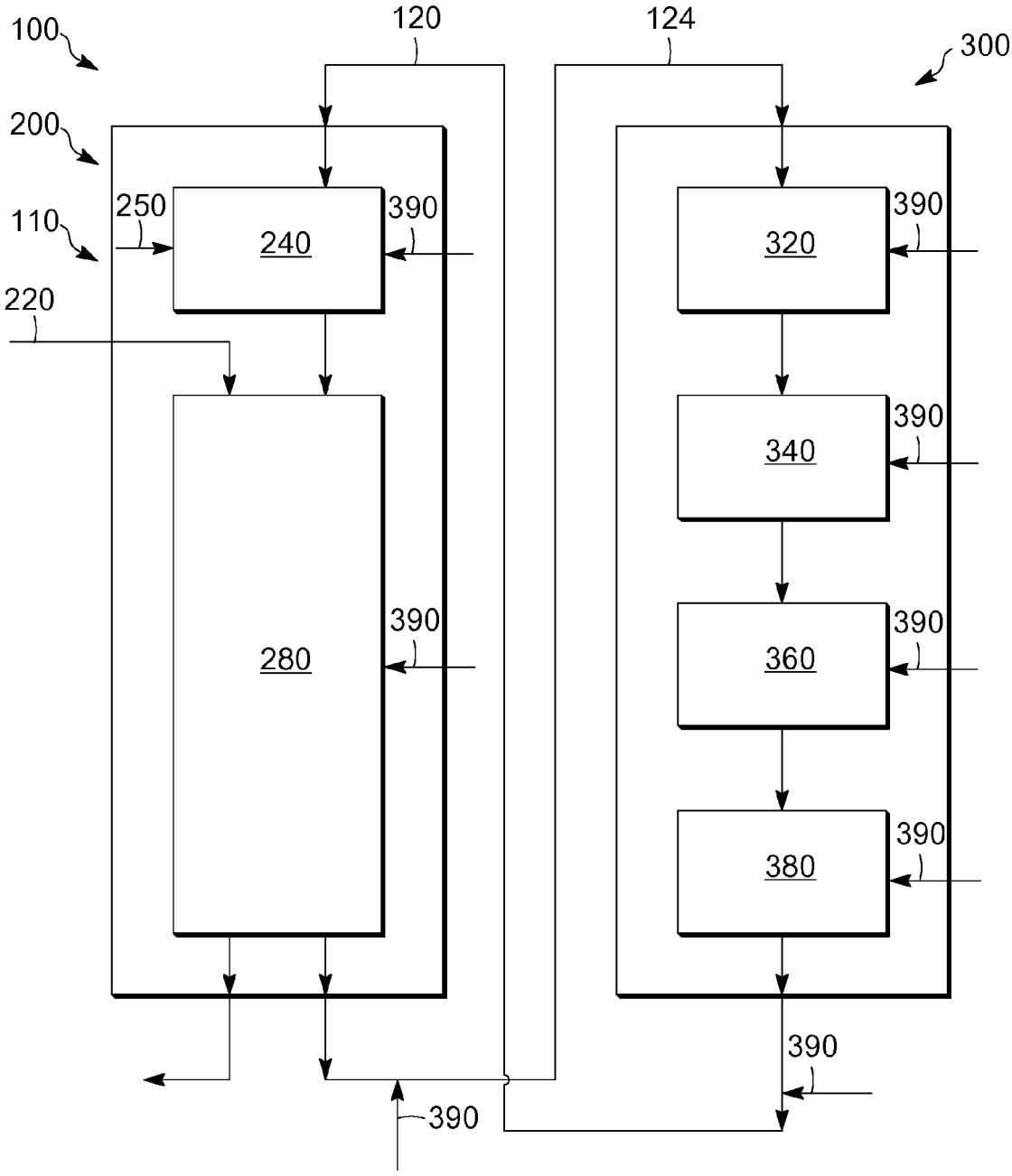
FIG. 1 is a schematic depiction of an exemplary catalytic naphtha reforming or reforming unit.

Referring to FIG. 1, an exemplary catalytic naphtha reforming or reforming unit 100 can include a first zone 200 including a reducing atmosphere and a second zone 300, which can be a regeneration zone 300, including an oxidizing atmosphere. Lifts 120 and 124 can transfer catalyst, generally in the form of pills, spheres, and/or extrudates, between the zones 200 and 300. Also depicted are several access points 390, which are discussed hereinafter. Such a unit 100 can provide continuous catalyst regeneration and exemplary units are disclosed in, for example, U.S. Pat. Nos. 5,958,216; 6,034,018; and US 2006/0013763 A1. The unit 100 can have portions operated at the same or different pressures, which can be atmospheric or greater. In one exemplary embodiment, a system 110 for the in situ transfer of a metal catalyst component can be associated with the unit 100 and is further discussed below.

Typically, a hydrocarbon feed 220 can be combined with a hydrogen-containing stream and then may be received in the first zone 200 that can include a reduction zone 240 and a reaction zone 280. Usually, the operating temperature in the first zone 200 is about 100-about 600° C., preferably about 350-about 600° C., and optimally about 500-about 600° C. The pressure can be in the range of about 100 kPa-about 1700 kPa. The first zone 200 can include the hydrocarbon feed 220, with at least one particle or catalyst as described further below, hydrogen, and a halogen component such as compound containing a fluoride or a chloride, preferably a chloride. To facilitate the transfer of a metal catalyst component from the donor to the recipient particle, desirably the mole ratio of halide:$H_2O$, preferably $Cl^-$:$H_2O$, is at least about 0.03:1, more preferably about 0.05:1-about 0.60:1. Typically, the concentration of hydrogen in a gas is at least about 15%, preferably at least about 50%, by mole. Usually, the hydrocarbon feed 220 for catalytic reforming is a petroleum fraction known as naphtha having an initial boiling point of about 82° C. and an end boiling point of about 204° C. The catalytic reforming process is particularly applicable to the treatment of straight run naphtha feeds as well as processed naphthas comprised of relatively large concentrations of naphthenic and substantially straight chain paraffinic hydrocarbons.

Generally, the regenerated catalyst (described in further detail hereinafter) enters the reduction zone 240 of the first zone 200 from the lift 120. The reduction zone 240 can include one or more sub-zones and/or reduction vessels and typically includes a reducing gas, such as hydrogen, to reduce one or more metal components present on the regenerated catalyst. The reducing gas can be provided via a line 250. Typically, a concentration of hydrogen in a gas is at least about 15%, preferably at least about 50%, and optimally at least about 75%, by mole, with the balance optionally being C1-C6 paraffinic hydrocarbons. In some preferred embodiments, a concentration of hydrogen in a gas can be about 60-about 99.9%, by mole. The temperature can be about 120-about 570° C., preferably about 200-about 350° C., at a pressure of about 450-about 1500 kPa. A mole ratio of halide: $H_2O$, desirably $Cl^-$:$H_2O$, is about 0.2:1-about 0.6:1.

Afterwards, the regenerated catalyst can pass to the reaction zone 280. The hydrocarbon feed 220 combined with a hydrogen-containing gas stream can be introduced at the top of the zone 280. The reaction zone 280 can include one or more sub-zones and/or reaction vessels with heaters between sub-zones or reactors for conducting reforming reactions. Reforming may be defined as the total effect produced by dehydrogenation of cyclohexanes and dehydroisomerization of alkylcyclopentanes to yield aromatics, dehydrogenation of paraffins to yield olefins, dehydrocyclization of paraffins and olefins to yield aromatics, isomerization of n-paraffins, isomerization of alkylcycloparaffins to yield cyclohexanes, isomerization of substituted aromatics, and hydrocracking of paraffins. Preferably, the reaction zone 280 includes a moving catalyst bed that can be countercurrent, cocurrent, crosscurrent, or a combination thereof, and the catalyst bed can be any suitable shape, such as rectangular, annular or spherical. The reaction zone 280 can be at a temperature of about 450-about 550° C., a pressure of about 270 kPa-about 1500 kPa, a hydrogen to hydrocarbon mole ratio from about 1-about 5, and a liquid hourly space velocity of about 0.5-about 4 $hour^{-1}$. A mole ratio of halide:$H_2O$, desirably $Cl^-$:$H_2O$, is about 0.03:1-about 0.1:1. In some preferred embodiments, a concentration of hydrogen in a gas can be about 55-about 65%, by mole. After the reforming reaction, the hydrocarbon stream can be sent for further processing and the catalyst can be passed to the lift 124 for regeneration.

The spent catalyst can exit the lift 124 into the regeneration zone 300. Typically, the catalyst fines are separated and removed before going to the regeneration zone 300. Generally, a temperature is about 40-about 700° C. and a pressure is about 100 kPa-about 520 kPa. Most of the regeneration zone 300 can operate from about 350-about 700° C. The regeneration zone 300 can include an incoming gas stream that has a halogen-containing compound in at least one sub-zone. To facilitate the transfer of a metal catalyst component from the donor to the recipient particle, desirably a halide:$H_2O$, preferably $Cl^-$:$H_2O$, with a mole ratio of no more than about 16:1, preferably no more than about 3.2:1, and optimally 0.02:1-3.2:1 is used.

The regeneration zone 300 can include an oxidation zone 320, a redispersion zone 340, a drying zone 360, and a cooling zone 380. The oxidation zone 320 can include an oxidizing atmosphere of about 0.5%-about 1.5%, by volume, oxygen. In some instances, the atmosphere may contain more than about 1.5%, by volume, oxygen. Typically, spent catalyst is contacted with the oxidizing atmosphere to remove accumulated coke on the catalyst surfaces. Moreover, chloride on the catalyst may also be stripped. Within the zone 320, coke is usually oxidized at a gas temperature of about 450-about 600° C. The pressure can be at atmospheric pressure or greater. A halide:$H_2O$, preferably $Cl^-$:$H_2O$, mole ratio can be about 0.003:1-about 0.030:1.

After exiting the oxidation zone 320, the catalyst particles can pass to the redispersion zone 340. In the redispersion zone 340, a gas is provided having a halogen-containing compound, such as a chloride compound for redispersing the catalyst metal. Generally, the redispersion gas also contains either chlorine or another chloro-species that can be converted to chlorine. Typically, the chlorine or chloro-species is introduced in a small stream of carrier gas added to the redispersion gas, so a small amount of a flue gas can be vented off to allow for the addition of the carrier gas. Generally, the redispersion is effected at a gas temperature of about 425-about 600° C., preferably about 510-about 540° C. Typically, a concentration of chlorine of about 0.01-0.2 mole percent of the gas and in the presence of oxygen is used to promote redispersion. A halide:$H_2O$, preferably $Cl^-$:$H_2O$, mole ratio can be about 0.07:1-about 16:1, preferably about 0.07:1-about 3.2:1.

The catalyst particles can pass to the drying zone 360 after passing through the redispersion zone 340. Typically, the catalyst particles are dried with air heated up to about 600° C., preferably up to about 538° C. Afterwards, the catalyst particles can be passed to the cooling zone 380 at a temperature of about 40-about 260° C. before passing through a lock hopper to the lift 124 to repeat in a continuous manner.

Referring to FIG. 1, the catalyst, which is typically the recipient catalyst, and the hydrocarbon feed 220 can pass through the first zone 200, and the catalyst can be regenerated in the second zone 300. Metals, such as indium, can leave the recipient catalyst under normal processing and regenerating conditions. One exemplary application is providing at least one donor particle to add a promoter, such as indium, to a recipient catalyst that has no indium initially or to further increase the indium present in the recipient catalyst.

The donor catalyst can be added anywhere to the unit 100, but preferably it is added to the first zone 200 including a reducing atmosphere, or the second zone 300 including an oxidizing atmosphere. In some exemplary embodiments, the existing catalyst can be removed at the access points 390 and the donor catalyst added.

In at least one preferred embodiment, controlling the halide to water ratio in either a reducing atmosphere or an oxidizing atmosphere can facilitate the transfer of the group IIIA element, such as indium, from the donor catalyst to the recipient catalyst. As an example, a halide, such as chloride, can be added to the oxidation zone 320, the redispersion zone 340, and the drying zone 360 to alter chloride content in those zones. Moreover, some of the added chloride can be transferred to the first zone 200 for controlling the chloride content in that zone. In addition, chloride can be added to the reduction zone 240 and/or the reaction zone 280 for controlling chloride content in these zones 240 and 280.

If the donor catalyst is added to the first zone 200, preferably the donor catalyst is added to the reduction zone 240 and/or the reaction zone 280 through the one or more access points 390. Desirably, a halide to water ratio is provided to facilitate the transfer of indium. Preferably to facilitate transfer, a $Cl^-/H_2O$ mole ratio of the reducing atmosphere is at least about 0.03:1, more preferably about 0.05:1-about 0.60:1. Typically, with respect to the reduction zone 240, it is desirable to operate at a higher temperature to facilitate the transfer of the group IIIA metal.

Alternatively, the donor catalyst can be added to the second or regeneration zone 300, preferably at the oxidation zone 320, the redispersion zone 340, and/or the drying zone 360 through one or more access points 390. Desirably, a halide to water ratio is provided to facilitate the transfer of indium. Preferably to facilitate transfer, a $Cl^-/H_2O$ mole ratio of the oxidizing atmosphere is no more than about 3.2:1, and more preferably about 0.2:1-about 3.2:1. Furthermore, the donor catalyst can be added at the cooling zone 380 and/or the lifts 120 and/or 124 at the access points 390.

The system 110 disclosed herein can provide at least one recipient particle in the reforming unit 100. The at least one recipient particle can be one or more catalyst particles circulating through the unit 100, as described above. Each catalyst particle can include a support and one or more additional components that can be incorporated into the support during its formation or incorporated afterwards. Generally, the support can be formed by an oil-drop method or extruded, although other methods can be utilized. The support can include a porous carrier material, such as a refractory inorganic oxide or a molecular sieve, and a binder in a weight ratio of about 1:99-about 99:1, preferably about 10:90-about 90:10. The carrier material can include:

(1) a refractory inorganic oxide such as an alumina, a magnesia, a titania, a zirconia, a chromia, a zinc oxide, a thoria, a boria, a silica-alumina, a silica-magnesia, a chromia-alumina, an alumina-boria, or a silica-zirconia;
(2) a ceramic, a porcelain, or a bauxite;
(3) a silica or a silica gel, a silicon carbide, a clay or a silicate synthetically prepared or naturally occurring, which may or may not be acid treated, for example an attapulgus clay, a diatomaceous earth, a fuller's earth, a kaolin, or a kieselguhr;
(4) a crystalline zeolitic aluminosilicate, such as an X-zeolite, an Y-zeolite, a mordenite, a β-zeolite, a Ω-zeolite or an L-zeolite, either in the hydrogen form or most preferably in nonacidic form with one or more alkali metals occupying the cationic exchangeable sites;
(5) a non-zeolitic molecular sieve, such as an aluminophosphate or a silico-alumino-phosphate; or
(6) a combination of one or more materials from one or more of these groups.

In one preferred embodiment, the porous carrier is an alumina, such as a gamma alumina.

The binder can include an alumina, a magnesia, a zirconia, a chromia, a titania, a boria, a thoria, a phosphate, a zinc oxide, a silica, or a mixture thereof.

The recipient particle or catalyst may contain one or more other components added during the formation of the support and/or incorporated afterwards. These components can be one or more metals or non-metals and include: (1) a group VIII element, (2) a group IIIA element, (3) a promoter such as a group IVA element, and (4) a halogen component.

Preferably, the group VIII element is platinum and the catalyst contains a catalytically effective amount. Typically, the catalyst contains about 0.01-about 2%, by weight, of the group VIII element, preferably platinum, based on the weight of the catalyst.

The catalyst can contain a promotionally effective amount of a group IIIA element, preferably indium, which may act as a promoter to change the catalyst performance by, e.g., facilitating the catalytic activity of the group VIII element, of the recipient catalyst. Typically, the recipient catalyst contains zero up to no more than about 1%, by weight, of the group IIIA element, preferably indium, based on the weight of the catalyst. The indium can be present as a metal on the catalyst or as one or more compounds, such as indium oxide, an alloy or a mixture of platinum, tin and indium, or indium chloride. The recipient catalyst may initially contain a group IIIA element, such as indium. Generally, the recipient catalyst can receive a promotionally effective amount of the group IIIA element, as described below. Particularly, the recipient catalyst can uptake at least about 0.005%, preferably at least about 0.05%, and optimally at least about 0.1%, by weight, of the, e.g., indium lost based on the weight of the donor particle. Although transferring specifically a group IIIA element is disclosed, it should be appreciated that transferring effective amounts of other metals providing promotional properties and/or catalytic activity is also contemplated.

Another promoter can be a group IVA element and/or other elements. A preferable group IVA element is tin, germanium, or lead, more preferably tin. Yet another promoter that optionally can be included is rhenium; a rare earth metal, such as cerium, lanthanum, and/or europium; phosphorus; nickel; iron; tungsten; molybdenum; titanium; zinc; or cadmium. Also, a combination of these elements can be used. Generally, the catalyst contains about 0.01-about 5%, by weight, based on the weight of the catalyst. Optionally, the catalyst may also contain one or more group IA and IIA metals (alkali and alkaline-earth metals) in about 0.01-about 5%, by weight, based on the weight of the catalyst.

The halogen component can be included in the catalyst and can be fluorine, chlorine, bromine, iodine, astatine or a combination thereof. Preferably the halogen component is chlorine. The recipient catalyst can contain typically about 0.1-about 10%, preferably about 0.5-about 2.0%, and optimally about 0.7-about 1.3%, by weight, of the halogen component, preferably chlorine, based on the weight of the catalyst.

Generally, the donor particle or catalyst can have the same or different composition as the recipient particle or catalyst, except the donor catalyst typically has greater amounts of a group IIIA element, as discussed further below. In particular, the donor catalyst can include the same materials, namely the support having a porous carrier and binder, and a group VIII element, a group IIIA metal catalyst component, a promoter such as a group IVA element, group IA and IIA metals, and a halogen component in the same or different weight ratios and weight percents as the recipient particle or catalyst discussed above. However, the donor catalyst generally has a greater amount of a group IIIA element, preferably indium.

Typically, the donor catalyst contains generally about 0.1-about 10%, preferably about 0.3-about 5%, and optimally about 1-about 5%, by weight, of the group IIIA element, preferably indium, based on the weight of the donor catalyst. Generally, the group IIIA, such as indium, is the transferred metal catalyst component. The indium can be present as a metal or one or more compounds, such as indium oxide, an alloy or a mixture of platinum, tin and indium, or indium chloride. Preferably, at least about 15%, at least about 20%, or even at least about 30%, by weight, of the indium is present as a non-reducible species after exposure of about 100%, by mole, hydrogen, at about 565° C. Although not wanting to bound by theory, it is believed that the presence of such non-reducible species facilitate the transfer of indium from the donor particle to the recipient particle.

In one preferred embodiment, a surface-layer of the donor catalyst can have a greater concentration of the group IIIA element, preferably indium, than the interior of the catalyst particle. Thus, a concentration gradient of the group IIIA element can be created from the surface to the interior of the particle.

Generally, the group IIIA element can be concentrated in the surface-layer of each particle, or the group IIIA element concentration can be greatest at the surface and gradually diminish towards the center. As used herein, a "layer" is a stratum of a particle of substantially uniform thickness at a substantially uniform distance from the surface of the particle. The "surface-layer" is the layer of the particle adjacent to the surface of the particle. Typically, the surface-layer concentration is the average of measurements within a surface-layer which may be up to about 350 microns deep or represent up to about 45% of the radius of the particle. The concentration of a surface-layer group IIIA element metal may taper off in progressing from the surface to the center of the particle, and can be substantially lower in the "central core" of the particle than in its surface-layer. A "central core"

may be defined as a core of a particle representing about 50% of the diameter, or about 50% of the volume of the particle. A "diameter" can be defined as the minimum regular dimension through the center of the particle; for example, this dimension would be the diameter of the cylinder of an extrudate. A "radius" may be defined as the distance from the surface to the center of the catalyst particle, being half of the diameter of the particle. For the extrudates, the central core may be a concentric cylindrical portion excluding the surface-layer at the side and ends of the cylindrical extrudate particles; a central core having about 50% of the volume of the extrudate particle generally would have a diameter about 70-about 75% of that of the particle.

As an example, the indium concentration can be greatest in a surface-layer about 300-about 350 microns thick for a spherical particle having a radius of about 800 microns. Particularly, the indium concentration can range from about 0.05-about 0.80 weight percent in the first 350 microns from the surface, and from about 0.0-about 0.30 weight percent from 350 microns from the surface to the center of the particle. Although not wanting to be bound by theory, it is believed that such a gradient can facilitate the transfer of the group IIIA element from the donor particle to the recipient particle. Such concentration gradients of a group IIIA element, such as indium, can be made as disclosed in U.S. Pat. No. 5,883,032. Although the non-reducible indium species and concentration gradients have been discussed for the donor particles, it is contemplated that the recipient particles may also have these attributes.

Generally, a catalytically effective amount of the group IIIA element is transferred from the donor particle to the recipient particle. Typically, at least about 0.005%, preferably at least about 0.05%, and optimally at least about 0.1%, by weight, of the group IIIA element is transferred from the donor particle, based on the weight of the donor particle.

The donor and recipient particles or catalysts can be made to methods known to those skilled in the art, as disclosed in US 2006/0102520 A1 and/or U.S. Pat. No. 5,883,032. The supports can be formed into spheres or extrudates optionally with one or more components.

The metal components may be incorporated in the support in any suitable manner, such as coprecipitation, ion-exchange or impregnation. A preferred method of preparing the catalyst can involve impregnating a porous carrier material with a soluble, decomposable group VIII compound. As an example, the platinum metal may be added by commingling the support with an aqueous solution of chloroplatinic, chloroiridic or chloropalladic acid. Other water-soluble compounds or complexes of group VIII metals may be employed in impregnating solutions and include platinum nitrate, platinum sulfite acid, ammonium chloroplatinate, bromoplatinic acid, platinum trichloride, platinum tetrachloride hydrate, platinum dichlorocarbonyl dichloride, dinitrodiaminoplatinum, sodium tetranitroplatinate (II), palladium chloride, palladium nitrate, palladium sulfate, diamminepalladium (II) hydroxide, tetraamminepalladium (II) chloride, hexa-amminerhodium chloride, rhodium carbonylchloride, rhodium trichloride hydrate, rhodium nitrate, sodium hexachlororhodate (III), sodium hexanitrorhodate (III), iridium tribromide, iridium dichloride, iridium tetrachloride, sodium hexanitroiridate (III), potassium or sodium chloroiridate, or potassium rhodium oxalate. Use of these compounds may also provide at least part of the halogen component, particularly by adding an acid, such as hydrogen chloride. In addition, the impregnation can occur after calcination of the support.

Similarly, the group IIIA metal may be incorporated in the support in any suitable manner, such as coprecipitation, ion-exchange or impregnation. A preferred method of preparing the catalyst can involve impregnating a porous carrier material with a soluble, decomposable group IIIA compound. As an example, an indium metal may be added by an impregnating aqueous solution of indium chloride ($InCl_3$) or indium nitrate ($In(NO_3)_3$) and hydrochloric acid. Use of these compounds may also provide at least part of the halogen component.

The promoter such as a group IVA metal may be incorporated in the catalyst in any suitable manner to achieve a homogeneous dispersion, such as by coprecipitation with the porous carrier material, ion-exchange with the carrier material, or impregnation of the carrier material at any stage in the preparation. One method of incorporating the group IVA metal component into the catalyst composite involves the utilization of a soluble, decomposable compound of a group IVA metal to impregnate and disperse the metal throughout the porous carrier material. The group IVA metal component may be impregnated either prior to, simultaneously with, or after the other components are added to the carrier material. Thus, the group IVA metal component may be added to the carrier material by commingling the carrier material with an aqueous solution of a suitable metal salt or soluble compound such as stannous bromide, stannous chloride, stannic chloride, or stannic chloride pentahydrate; or germanium oxide, germanium tetraethoxide, or germanium tetrachloride; or lead nitrate, lead acetate, or lead chlorate. The utilization of metal chloride compounds may also provide at least part of the halogen component. In one preferred embodiment, at least one organic metal compound such as trimethyltin chloride and/or dimethyltin dichloride are incorporated into the catalyst during the peptization of the inorganic oxide binder, preferably during peptization of alumina with hydrogen chloride or nitric acid.

Other promoters such as rhenium; a rare earth metal, such as cerium, lanthanum, and/or europium; phosphorus; nickel; iron; tungsten; molybdenum; titanium; zinc; cadmium; or a combination thereof can be added to the carrier material in any suitable manner during or after its preparation or to the catalytic composite before, during or after other components are incorporated.

With respect to the halogen component, the halogen component can be added with one or more of the metals and/or one or more promoters. Furthermore, the halogen component can be adjusted by employing a halogen-containing compound, such as chlorine or hydrogen chloride, in air or an oxygen atmosphere at a temperature of about 370-about 600° C. Water may be present during the contacting step in order to aid in the adjustment.

The components can be impregnated together, e.g., co-impregnated, or separately with one or more optional calcination steps there between. As discussed above, a catalyst precursor can be calcined in separate steps between impregnations. In one preferred embodiment, the group IIIA element, preferably indium, is impregnated and calcined at least about 700° C., desirably about 700-about 900° C. Although not wanting to be bound by theory, it is believed that the high temperature calcination can create non-reducible species of indium, which may facilitate the transfer of indium from the donor particle to the recipient particle. As discussed above, the donor particle can contain at least about 15%, by weight, of a non-reducible species of indium on the donor catalyst based on the weight of indium present on the donor catalyst.

The amount of material contained by the donor and/or recipient particles can be determined by methods known to those of skill in the art. As an example, UOP method 274-94 can be used for platinum and other group VIII metals, UOP method 303-87 can be used for tin and other group IVA metals, and UOP method 873-86 can be used for noble metals and modifiers, particularly indium, in catalysts by inductively coupled plasma atomic emission spectroscopy. The halogen component, particularly chloride, can be determined by UOP method 979-02 by x-ray fluorescence or by UOP method 291-02 by potentiometric titration.

ILLUSTRATIVE EMBODIMENTS

The following examples are intended to further illustrate the subject particle(s). These illustrations of embodiments of the invention are not meant to limit the claims of this invention to the particular details of these examples. These examples are based on engineering calculations and actual operating experience with similar processes.

EXAMPLE 1

Seven samples of particles are made with varying orders of impregnation and optionally calcination at a temperature of at least about 750° C. in air (abbreviated "HiT") on the base or between metal impregnations. Samples 1 and 6 are made with a high temperature calcination of 865° C. between the indium and the platinum impregnations.

The supports are made by an oil drop method followed by standard heat treatment procedures. Tin is incorporated into the aluminum sol such that the formed support contains about 0.30%, by weight, tin. The support of a Sample 7 is made in similar fashion except that indium chloride solution is added along with a tin-containing solution to the aluminum sol and co-gelled by the oil drop method. The indium is impregnated on the supports from an aqueous solution containing indium chloride or indium nitrate and hydrogen chloride. The platinum is impregnated onto the supports from an aqueous solution of chloroplatinic acid and hydrogen chloride. For the indium and platinum co-impregnations, an aqueous solution of the indium compound, chloroplatinic acid and HCl is used. All the samples are then oxidized in an air flow of about 1000 $hr^{-1}$ gas hourly space velocity (GHSV), at about 510° C. for 8 hours, while simultaneously injecting a hydrogen chloride solution and chlorine gas. The catalysts are reduced in a 425 GHSV mixture of nitrogen and 15%, by mole, hydrogen. The reduction temperature is about 565° C. and is held for two hours.

The following table depicts the methodology and final weight percents of metals and halogen component on each support.

TABLE 1

| Sample No. | 1 | 2 | 3 | 4 | 5 | 6 | 7 |
|---|---|---|---|---|---|---|---|
| Base Average Bulk Density (g/cc) | 0.58 | 0.58 | 0.58 | 0.57 | 0.57 | 0.69 | 0.59 |
| Base Formed | With Sn | With Sn | With Sn | With Sn | With Sn | With Sn | With Sn and In |
| HiT on Base | No | No | Yes | No | Yes | No | No |
| Impregnations | In, HiT, Pt | Co In + Pt | Co In + Pt | Im In | Im In | In, HiT, Pt | Im Pt |
| Wt. % Pt | 0.30 | 0.31 | 0.30 | 0 | 0 | 0.26 | 0.30 |
| Wt. % Sn | 0.30 | 0.30 | 0.30 | 0.30 | 0.30 | 0.30 | 0.29 |
| Wt. % In | 0.30 | 0.26 | 0.31 | 0.30 | 0.30 | 0.26 | 0.59 |
| Wt. % $Cl^-$ | 1.05 | 0.93 | 1.06 | 0.94 | 0.95 | 1.04 | 1.22 |

Table Abbreviations:

In, HiT, Pt: Impregnation by indium followed by high temperature calcination then impregnation by platinum Co: Co-impregnation with, e.g., In and Pt Im Xx: Impregnation with a metal such as In or Pt Wt. % Final weight percent of metal or chloride in catalyst based on weight of catalyst The seven samples are subjected to in situ x-ray absorption near edge structure (XANES) scans. Generally, a XANES scan is collected over a shorter energy range than an extended x-ray absorption fine structure (EXAFS) scan, and thus takes less time to collect. The shorter time frame means that XANES data can be used to monitor dynamic processes such as changes in oxidation state that occur during reductions.

Information on the oxidation state of indium in the seven samples is obtained by XANES during an in-situ temperature programmed reduction study which is done by ramping from room temperature to 565° C. at 7.5° C./min. in 100%, by mole, hydrogen followed by a hold period at 565° C. for 30 min.

Figure 2:
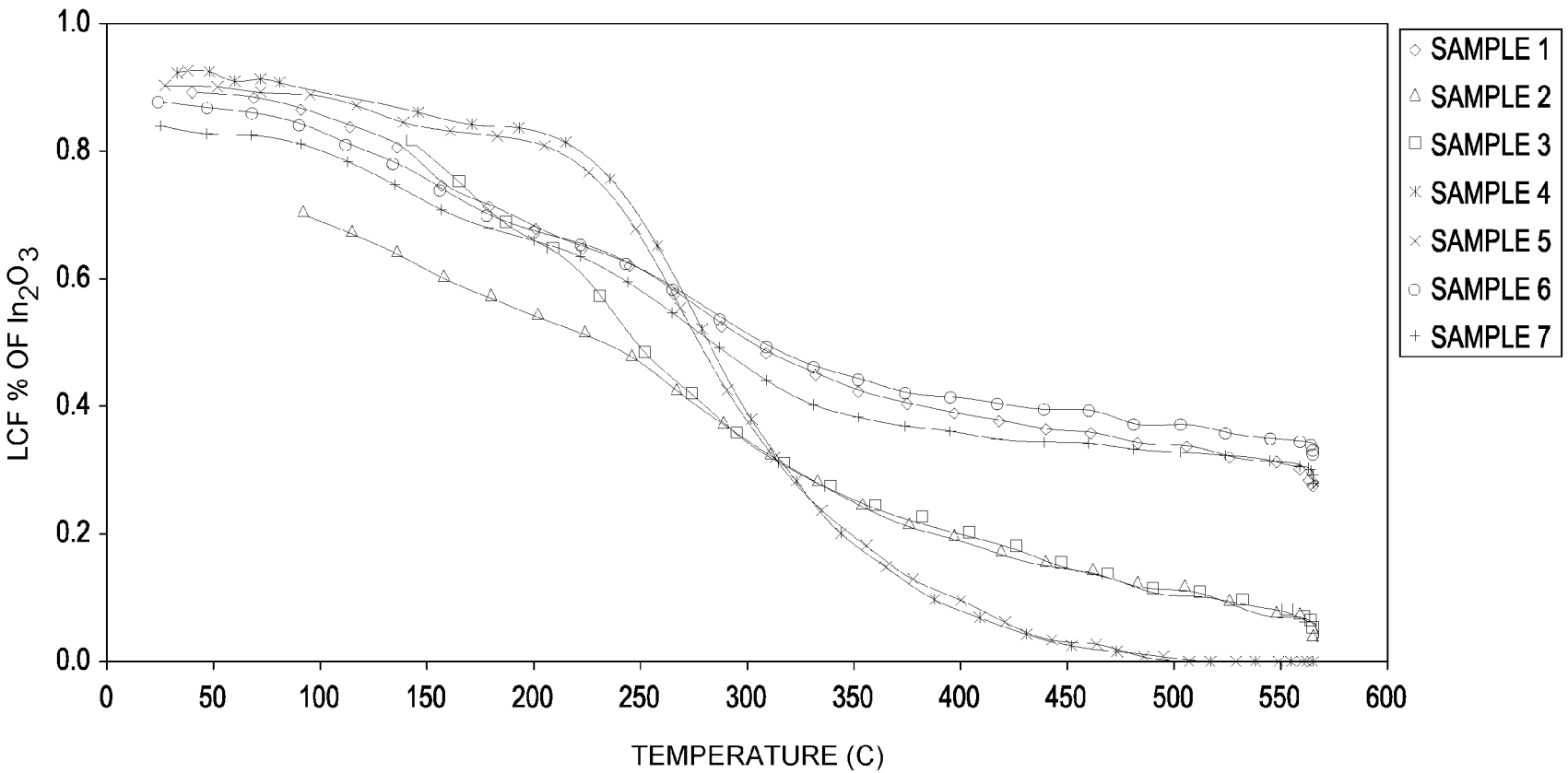
FIG. 2 is a graphical depiction of experimental results.

Referring to FIG. 2, a graph is depicted of a linear curve fit (which may be abbreviated "LCF") of indium oxide percentage (unreduced indium) on a relative scale versus temperature for the seven samples. As depicted, Samples 1, 6 and 7 have the greatest amounts of unreduced indium oxide. Particularly, Samples 1 and 6 have a high temperature calcination of 865° C. between the indium and the platinum impregnations. On the other hand, Sample 7 has unreduced indium made by incorporating indium into the aluminum sol during the formation of the alumina base. Thus, it appears that one method of providing a greater percentage of unreduced indium is providing a high temperature calcination between impregnations of indium and platinum.

EXAMPLE 2

Two catalyst samples are made and tested for loss of indium. The catalysts include supports made by an oil drop method with the tin incorporated into the aluminum sol followed by a standard heat treatment procedure, i.e., a calcination under 750° C. The first sample (Sample 8) is made by impregnating indium onto an alumina support followed by a high temperature calcination (greater than 750° C.) and then followed by a separate platinum impregnation. The second sample (Sample 9) is made by co-impregnating indium and platinum on a gamma alumina support with no intermediate high temperature calcination. After the impregnations, each sample is treated in a similar fashion including oxychlorination and reduction treatments to obtain final chloride levels. The final composition of each sample in weight percent based on the catalyst is depicted in the following table:

TABLE 2

| Component | Sample 8 (Weight Percent) | Sample 9 (Weight Percent) |
|---|---|---|
| In | 0.31 | 0.32 |
| Pt | 0.30 | 0.30 |
| Sn | 0.27 | 0.30 |
| Cl | 1.18 | 1.06 |

The indium levels for each of the Samples 8 and 9 are measured before and after exposure to an oxidizing environment or a reducing environment for 10 hours. The oxidizing environment includes air (78%, by mole, nitrogen and 21%, by mole, oxygen) and the reducing environment includes a reducing gas (85%, by mole, nitrogen and 15%, by mole, hydrogen) and hereinafter is abbreviated "RG" in the table below. Water and chloride are added during the treatments at levels generally consistent with commercial regeneration conditions. The table below depicts the conditions:

TABLE 3

| Conditions | Temperature (° C.) | Mole Percent of Gases in Environment (Total: ~100%) | | | $Cl^-/H_2O$ (Mole Ratio) |
|---|---|---|---|---|---|
| | | Air or RG | Water | HCl | |
| 1 | 650 | Air: 95.5 | 4.2 | 0.35 | 0.08 |
| 2 | 650 | Air: 95.1 | 4.2 | 0.70 | 0.17 |
| 3 | 570 | RG: 99.0 | 1.0 | 0.05 | 0.05 |
| 4 | 570 | RG: 98.8 | 1.0 | 0.17 | 0.17 |

The results with respect to indium loss at the conditions in Table 3 are depicted in the table below:

TABLE 4

| Condition | Sample 8 (Wt. % Indium Loss Based on Wt. of Indium) | Sample 9 (Wt. % Indium Loss Based on Wt. of Indium) |
|---|---|---|
| 1 | 3.2 | 1.9 |
| 2 | 2.6 | 1.0 |
| 3 | 5.8 | 2.5 |
| 4 | 6.8 | 3.2 |

As depicted, indium is lost for both samples under both oxidizing and reducing conditions. However, indium losses are more pronounced under reducing conditions. Sample 8 shows significantly higher indium losses than Sample 9. It is believed that this result demonstrates the effect of the intermediate calcination between indium and Pt impregnations creating unreduced indium species and increasing the indium that can be lost and donated to recipient particles.

EXAMPLE 3

Samples 8 and 9 are exposed again at Condition 4 as depicted in Table 5 for a period of 100 hours. The results after 100 hours along with the Condition 4 results after 10 hours from Example 2 are depicted in the table below:

TABLE 5

| Time at Condition 4 | Sample 8 (Wt. % Indium Loss Based on Wt. of Indium) | Sample 9 (Wt. % Indium Loss Based on Wt. of Indium) |
|---|---|---|
| 10 hours | 6.8 | 3.2 |
| 100 hours | 15.4 | 14.9 |

As depicted, longer time exposure can result in greater loss of indium. However, Sample 8 appears to transfer indium at a greater rate than Sample 9.

Moreover, a gamma alumina support (weighing about 117 g) with zero initial indium is placed in the reactor tube below Sample 8 (weighing about 111 g). The support is kept in the high temperature zone for 100 hours. After the experiment, the loss of indium is measured on Sample 8 and the gain of indium is measured on the support. The loss of indium on Sample 8 is measured to be 0.05%, by weight, indium based on the weight of Sample 8, while the uptake on the gamma alumina support at high temperature is 0.04%, by weight, indium, based on the weight of the support. This experiment demonstrates the transfer of indium to a sample that originally contained zero indium.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth uncorrected in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for facilitating a transfer of a metal catalyst component from at least one donor particle to at least one recipient particle in a catalytic naphtha reforming unit, comprising:

A) transferring an effective amount of the metal catalyst component from the at least one donor particle to the at least one recipient particle under conditions to effect such transfer to improve a conversion of a hydrocarbon feed wherein the at least one donor particle comprises:

a group VIII element;

a group IVA element;

a halogen component; and a group MA element comprising indium as the transferred metal catalyst component; wherein the group MA element comprises more than about 15%, by weight, of a non-reducible species after exposure for about 30 minutes in atmosphere comprising about 100% hydrogen, by mole, at a temperature of about 565° C., and wherein the at least one donor particle is prepared by calcining at a temperature of at least about 700° C. between incorporations of indium and the group VIII element on a respective support of the at least one donor particle.

2. The process according to claim 1, wherein the at least one donor particle has a greater concentration of the metal catalyst component than the at least one recipient particle.

3. The process according to claim 2, wherein the at least one recipient particle further comprises a halogen component.

4. The process according to claim 1, wherein the at least one recipient particle, comprises:

a group VIII element;

a group IIIA element as the transferred metal catalyst component;

a group IVA element; and a halogen component.

5. The process according to claim 4, wherein the group IIIA element comprises indium, and the at least one donor particle comprises about 0.1-about 10%, by weight, indium and the at least one recipient particle comprises no more than about 1.0%, by weight, indium, based on the weight of the respective particle.

6. The process according to claim 5, wherein the indium of the at least one donor particle is mostly comprised in a surface-layer to form a gradient from the surface layer to the central core of the at least one donor particle.

7. The process according to claim 5, wherein the at least one recipient particle uptakes at least about 0.005%, by weight, of the indium lost by and based on the weight of the at least one donor particle.

8. The process according to claim 1, wherein the reforming unit comprises:

a reduction zone;

a reaction zone; and a regeneration zone comprising an oxidation zone, a redispersion zone, and a drying zone; wherein the process further comprises:

adding the at least one donor particle to at least one of the reduction zone, the reaction zone and the regeneration zone.

9. The process according to claim 8, wherein the at least one donor particle is added to the reduction zone or the reaction zone and the transfer occurs in a reducing atmosphere comprising hydrogen.

10. The process according to claim 9, wherein a $Cl^-/H_2O$ mole ratio of the reducing atmosphere is at least about 0.03:1 and the transfer occurs at a temperature of about 350-about 600° C.

11. The process according to claim 10, wherein the $Cl^-/H_2O$ mole ratio of the reducing atmosphere is about 0.05:1-about 0.60:1.

12. The process according to claim 8, wherein the at least one donor particle is added to the regeneration zone and the transfer occurs in an oxidating atmosphere comprising oxygen.

13. The process according to claim 12, wherein a $Cl^-/H_2O$ mole ratio of the oxidizing atmosphere is no more than about 3.2:1 and the transfer occurs at a temperature of about 350-about 700° C.

14. The process according to claim 13, wherein the $Cl^-/H_2O$ mole ratio of the oxidating atmosphere is about 0.2:1-about 3.2:1.

* * * * *

UNITED STATES PATENT AND TRADEMARK OFFICE

CERTIFICATE OF CORRECTION

PATENT NO. : 7,909,988 B2
APPLICATION NO. : 12/104482
DATED : March 22, 2011
INVENTOR(S) : Mark P. Lapinski et al.

It is certified that error appears in the above-identified patent and that said Letters Patent is hereby corrected as shown below:

Column 14
Line 51 replace “MA” with --IIIA--.

Column 14
Line 53 replace “MA” with --IIIA--.

Signed and Sealed this
First Day of January, 2013

David J. Kappos

David J. Kappos
*Director of the United States Patent and Trademark Office*